US007892064B2

(12) United States Patent
Carruth

(10) Patent No.: US 7,892,064 B2
(45) Date of Patent: Feb. 22, 2011

(54) PORTABLE MULTIFUNCTION INTERACTIVE PLAY/ACTIVITY BACKPACK HOUSE

(76) Inventor: George Carruth, 8201 Heller Rd., Whitehouse, OH (US) 43571

( * ) Notice: Subject to any disclaimer, the term of this patent is extended or adjusted under 35 U.S.C. 154(b) by 1195 days.

(21) Appl. No.: 10/973,036

(22) Filed: Oct. 25, 2004

(65) Prior Publication Data

US 2005/0090179 A1 Apr. 28, 2005

Related U.S. Application Data

(60) Provisional application No. 60/513,833, filed on Oct. 23, 2003.

(51) Int. Cl.
*A63H 3/00* (2006.01)

(52) U.S. Cl. ..... 446/73; 446/487; 190/109

(58) Field of Classification Search ..... 446/71–73, 446/75–77, 478, 487; 206/457; 190/109
See application file for complete search history.

(56) References Cited

U.S. PATENT DOCUMENTS 4,853,994 A * 8/1989 Ekstein ..... 5/639
4,874,340 A 10/1989 Smallwood
4,883,443 A * 11/1989 Chase ..... 446/478
4,909,542 A * 3/1990 Marks ..... 281/15.1
4,946,413 A * 8/1990 Lehmann et al. ..... 446/28
D320,501 S 10/1991 Marks
5,120,262 A * 6/1992 Caine ..... 446/476
5,136,726 A * 8/1992 Kellin et al. ..... 2/244
5,255,834 A * 10/1993 Bendersky ..... 224/657
5,525,088 A * 6/1996 Mayne ..... 446/75
5,649,658 A * 7/1997 Hoffman et al. ..... 224/576
5,734,991 A * 4/1998 Schmid ..... 2/69
5,878,672 A * 3/1999 Ostermann et al. ..... 108/44
D450,447 S 11/2001 Willingham et al.
6,464,098 B1 10/2002 Henson et al.
6,769,588 B2 * 8/2004 Zheng ..... 224/576
2003/0124948 A1 7/2003 Ostolaza

* cited by examiner

*Primary Examiner*—Bena Miller
(74) *Attorney, Agent, or Firm*—Connolly Bove Lodge & Hutz LLP; Paul E. Crawford

(57) ABSTRACT

A portable backpack which doubles as a play activity center is disclosed. It is a portable entertainment center with numerous features for engaging young children in imaginative play. The front of the backpack is hinged to open an interior area where play toys and accessories can be located to simulate a dollhouse, space vehicle, barn or like play themes. The backpack is made of shape retaining materials that are nevertheless soft to the touch but crushable, and collapsible to minimize injury to the user and wear-and-tear during playful use by children. Various features such as a swing, ladder, escape hatch, windows, operable doors, promote imaginative play. Some embodiments of the backpack include colorful replicas of butterflies, beetles, etc. on the front to attract attention of peers to the backpack and its owner.

11 Claims, 5 Drawing Sheets

Fig. 4.
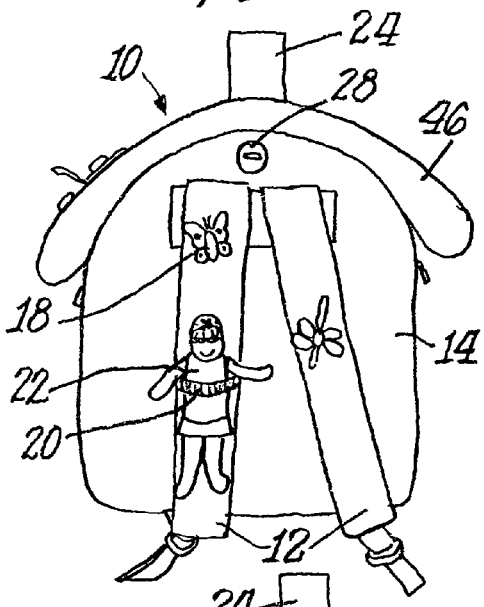
Fig. 5.
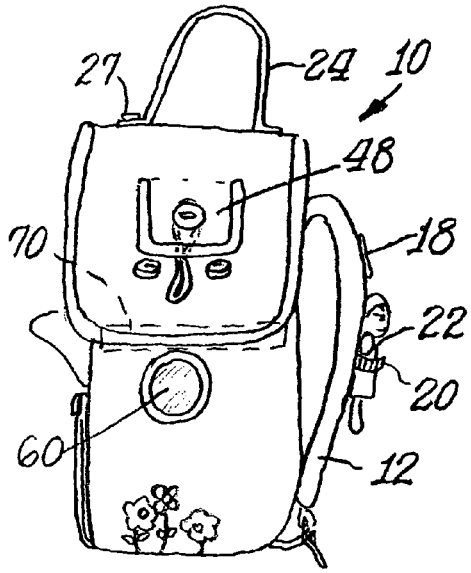
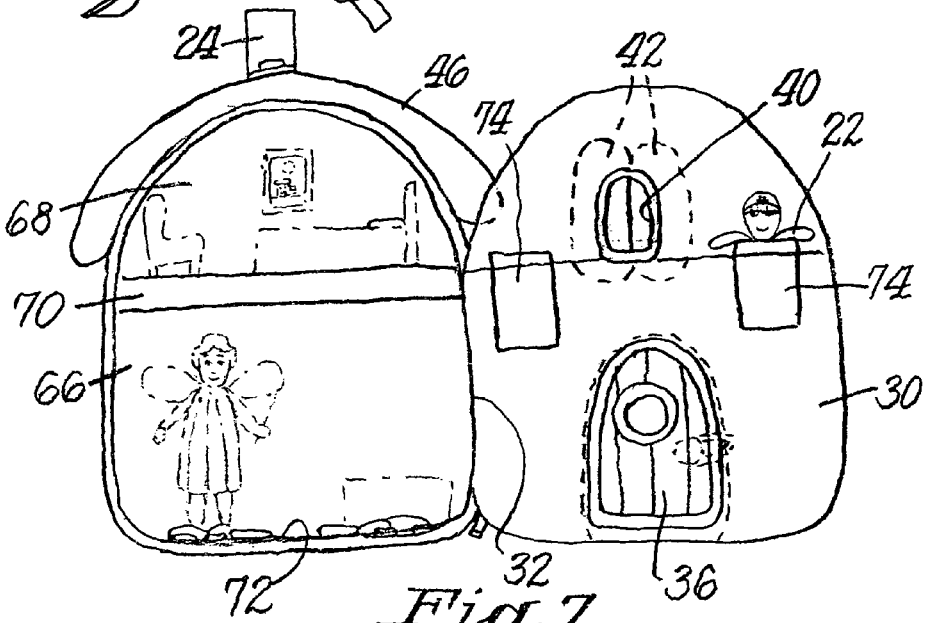
Fig. 7.

PORTABLE MULTIFUNCTION INTERACTIVE PLAY/ACTIVITY BACKPACK HOUSE

CROSS-REFERENCE TO RELATED APPLICATION

This application is based on the disclosure of applicant's U.S. Provisional Application Ser. No. 60/513,833 filed Oct. 23, 2003, the benefit of which is requested pursuant to 35 U.S.C. 119(e).

BACKGROUND OF THE INVENTION

Various approaches have been taken by others to provide portability to juvenile play materials. Those approaches are described below:

U.S. Pat. No. 4,874,340 issued Oct. 17, 1989 discloses an "amusement"/storage device which has the appearance of a book. On the cover of the "book" are straps to hold a favorite stuffed animal (See FIGS. 1-2). Book text is printed on a flexible fabric attached to the inside spline of the "book". (See FIG. 2 and column 4, lines 29-47). Pouches for holding other child amusement devices may be sown into the inside covers of the book (FIG. 2 and column 4, line 49 to column 5, line 6). Various carrying straps (see reference numeral 56 in FIG. 2) and elongated backpack straps (reference 64 in FIG. 3) are also disclosed. The "book" may also be used as a "pillow" or diaper changing device (column 5, lines 31-52).

U.S. Pat. No. 6,464,098 issued Oct. 15, 2002 discloses a portable utility organizer containing multiple shelves for storage of camping supplies (See FIG. 1).

U.S. Pat. No. Des. 320,501 issued Oct. 8, 1991 and U.S. Pat. No. D450,447 issued Nov. 20, 2001 illustrate examples of decorative backpacks featuring various well known juvenile caricatures such as Raggedy Andy.

U.S. Patent Publication No. 2003/0124948 A1 dated Jul. 3, 2003 discloses a "transportable play system" in the form of a backpack that unfolds into a relatively flat play surface on which play pieces can be adhered (See FIG. 3A and paragraph [0010]). The flat play surface can also be configured as a game board (paragraph [0011]).

Applicants are also aware of a very recent (Fall 2003) advertisement of a portable cloth play dollhouse with a handle on it called a "Halfpenny Playhouse" which is described at www.hearthsong.com.

SUMMARY OF THE INVENTION

The interactive backpack of this invention offers multiple play opportunities for juveniles in a variety of venues ranging from a bedroom to the backseat of a car. It is much more than a container for toys or play accessories. It is a portable entertainment device with numerous features designed to spark the imagination and engage the interest of young children.

The backpack has multiple attachments that facilitate varied uses. Adjustable straps on the back permit carrying it as a traditional backpack. One or both of such straps are decorated and/or contain adjustable, expandable bands to hold dolls, accessories or decorative features. One or more multifunction straps are located on the top of the backpack which facilitate holding the backpack on everything from a tree limb to a door knob.

The backpack is preferably made of shape retaining materials that are nevertheless soft to the touch and crushable, collapsible, thereby avoiding injury to the user and providing a comfortable, tactile-pleasing surface that can withstand movement and active play. The backpack can be created to replicate a variety of attractive articles such as a dollhouse, play house, barn, schoolhouse or action designs like a space shuttle, airplane, tank, truck or the like.

The interactivity of the backpack is enhanced by several features in addition to the use of shape retaining materials to form the body thereof. More particularly, the front of the backpack is hinged on one or more hinges so that the full interior of the backpack is open and available for imaginative play. This door to imagination can be zippered shut, or fastened closed with buttons, Velcro® fasteners or the like.

The interior of the backpack preferably has at least two lateral play surfaces. To enhance imaginative play activities, a swing and/or ladder may be detachably connected to the base of the backpack. Operable doors, windows and trap doors on the vertical surfaces or top of the backpack further enhance imaginative play. At last one window preferably includes a clear see-through pane. Pockets on one or more vertical surfaces hold related toys and accessories.

The backpack is ideal for children playing at home or at a friend's house. The toys and accessories to be used with the backpack can be stored inside when traveling with the backpack. Once settled in a play location, whether at a friend's house or the backseat of a parent's automobile, the front of the backpack can be opened, the swing and ladder deployed, and the toys and accessories displayed wherever the child's imagination wishes.

In another embodiment of this invention, the front of the backpack (facing others) is shaped in the form of a colorful creature, for example a butterfly, beetle, ladybug, or the like. These colorful creatures draw favorable attention from a child's peers thereby enhancing interaction with other children. This enhanced attention from others can lead to new friendships and improved self esteem of the backpack user.

DESCRIPTION OF THE DRAWINGS

FIG. 4 is a rear elevational view of the playhouse backpack;

FIG. 5 is a right side elevational view of the playhouse backpack;

FIG. 7 is a front elevational view of the playhouse backpack with the front panel of the playhouse opened to show the internal details of the backpack;

FIG. 11 illustrates the carrying strap in an alternative position usable to attach the backpack to a door knob, tree limb, car seat or the like.

DETAILED DESCRIPTION OF THE INVENTION

The backpack 10 of this invention is much more than a portable toy container. It is an interactive playhouse which facilitates imaginative playtime activities. Moreover, because it is portable and highly attractive, it promotes interaction with peers and thus has the added benefit of improving social interaction with the child possessing the backpack of this invention.

Figure 3:
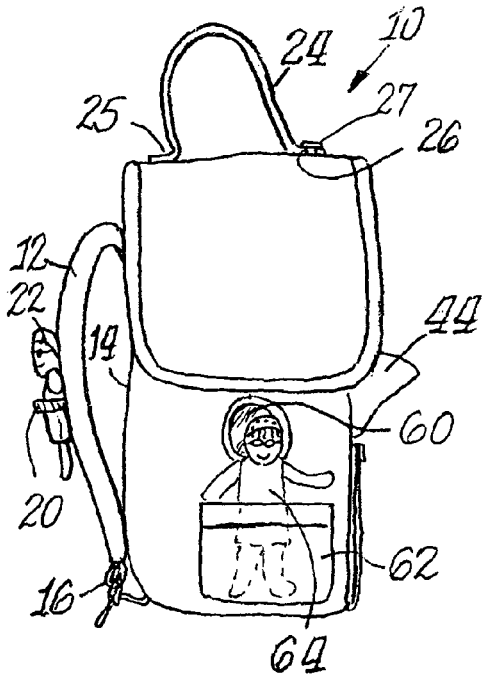
FIG. 3 is a left-side elevational view of the playhouse backpack.
Figure 2:
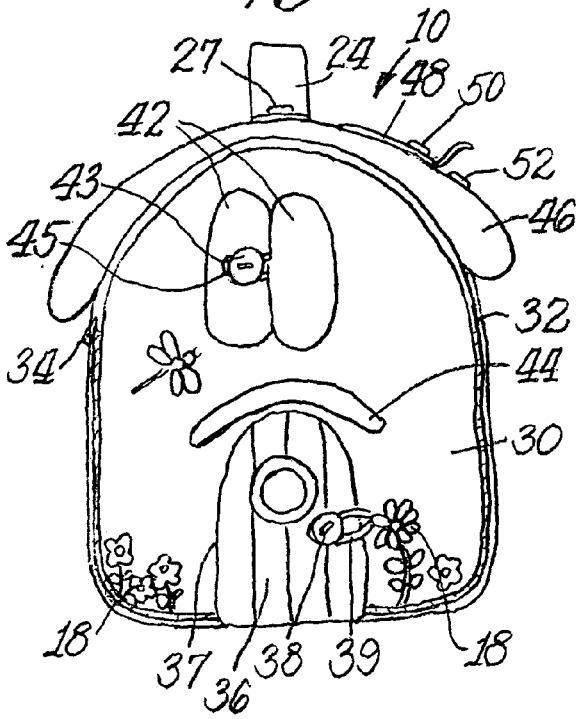
FIG. 2 is a front elevational view of the playhouse backpack.

The backpack 10 contains shoulder straps 12 attached to the back 14 of the backpack 10 (See FIG. 3). The straps 12 are preferably adjustable using slip rings or buckles 16 in a manner well known to those skilled in the art. The shoulder straps are preferably decorated with lively and colorful appliqués 18, for example, depicting flowers, colorful insects or the like. The straps may also contain elastic and/or adjustable bands 20 which hold toys 22 or accessories usable in, or associated with, the backpack 10.

Figure 1:
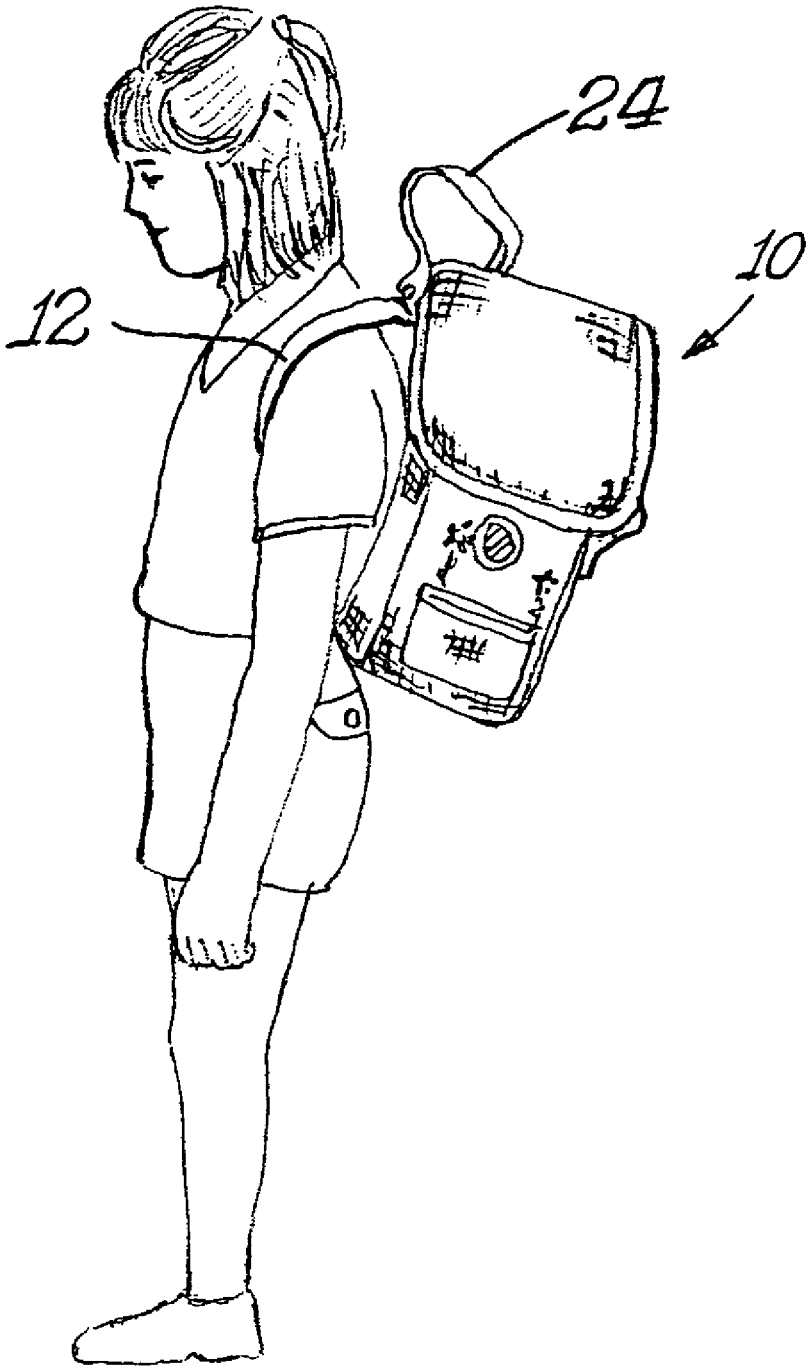
FIG. 1 is a pictorial view showing a child wearing one embodiment of this invention, i.e., a playhouse.
Figure 6:
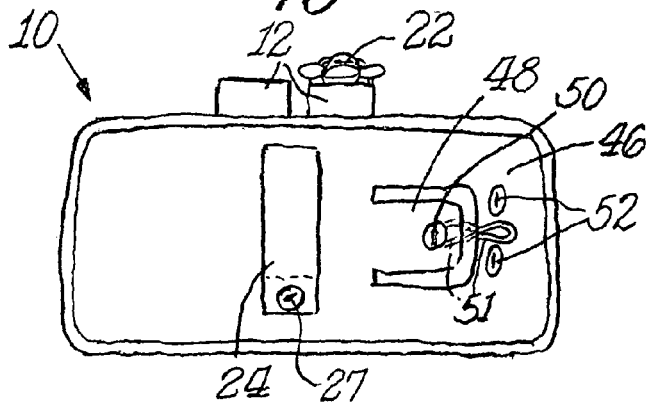
FIG. 6 is a top plan view of the playhouse backpack.
Figure 11:
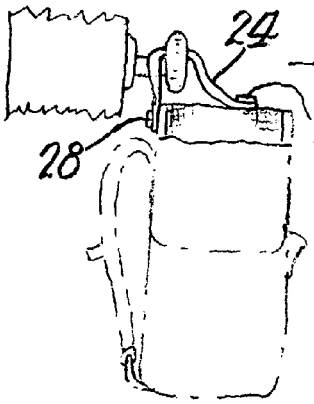

A multipurpose strap 24 is attached to the top of backpack 10. The strap 24 is preferably fixedly attached to backpack 10 at one end 25 thereof and contains a button hole 26 therein. The end of strap 24 containing buttonhole 26 may be attached to button 27 on top of the backpack (FIGS. 3-6) or to button 28 on the back of backpack 10 (See FIGS. 1, 11) depending upon the location and use of the backpack. For example, attachment of the strap 24 to button 27 on the top of backpack 10 facilitates carrying the backpack by hand or suspending it from a tree limb or peg. Alternatively, the strap 24 can be passed through a backrest in an automobile and attached to button 28 to facilitate use of the backpack by a child in an automobile. This arrangement can also be used to mount the backpack on a doorknob or post as shown in FIG. 11. Of course, fasteners other than buttons can be used to provide this flexible attachment of strap 24 to backpack 10.

The body of backpack 10 is preferably constructed of shape-retaining materials, but are soft to the touch and crushable and collapsible upon impact. This provides the unique advantage of creating a fixed play space in which children can play with toys and accessories while avoiding hard surfaces and edges that can cause injury. Preferred soft, shape-retaining materials for use in the body of the backpack 10 include soft fleece laminated on both sides of a foam core. Other materials can be used such as smooth, shiny fabric over a foam core to replicate metal structures like space ships described below.

Figure 8:
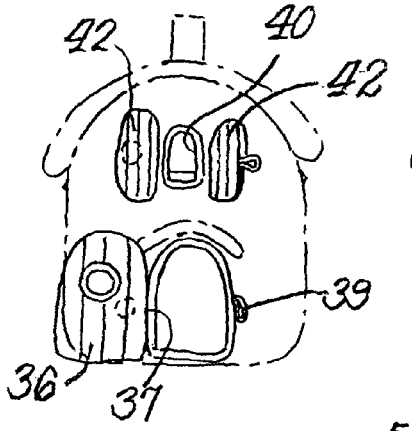
FIG. 8 illustrates features of the backpack front panel including a openable door and window shutters.

The principal access to the interior of the backpack is through the front panel 30. In the preferred embodiment, the front panel 30 is attached to the body of backpack 10 with a cloth hinge 32. When not open, the front panel is held in place as part of the backpack 10 with a zipper 34 or other fastener, for example Velcro®. Front panel 30 preferably has access ports therein, including door 36. Door 36 is openable to facilitate simulation of play activity mimicking a situation where someone is knocking on the door. A cloth hinge 37 holds the door in place on front panel 30 (See FIG. 8) and a button 38 and loop 39 attached to front panel 30 provide a closure for door 36 that is suited for operation by little fingers. Front panel 30 may also contain one or more window openings 40. Shutters 42 can be used to cover the window 40. The shutters may be attached to front panel 30 with a cloth hinge and maintained closed with a button 43 and loop 45 or other fastener. Appliqués 18, preferably complementing those on straps 24, can be used on the front panel 30 to provide a joyful, attractive overall appearance to backpack 10. Rounding out the front panel 30 is a cloth eave 44 over door 36.

Figure 9:
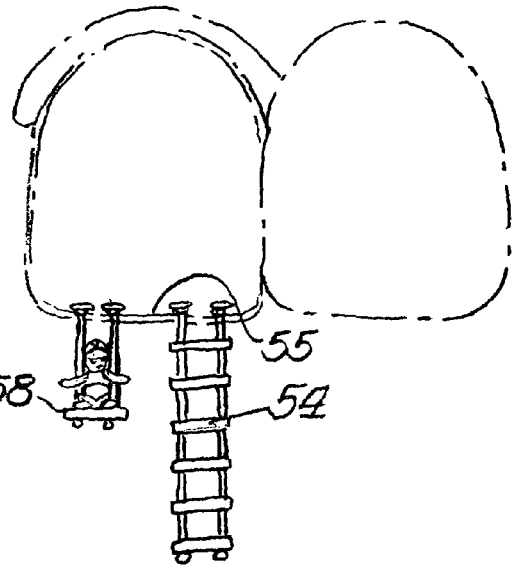
FIG. 9 illustrates play features attached to the backpack, namely, a detachable swing and detachable ladder.
Figure 10:
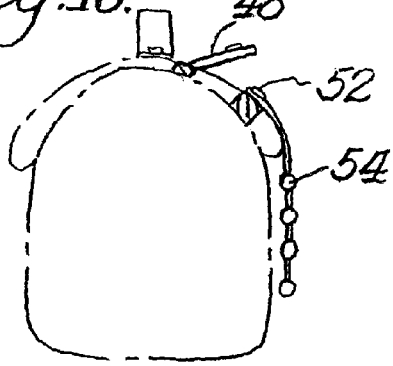
FIG. 10 illustrates an alternate deployment of the ladder, namely, attached to the escape hatch in the top of the backpack.

The top or roof 46 of backpack 10 can contain a mysterious (to children) escape hatch 48 that assists in imaginative play, for example, extracting an imaginary character from confinement within the backpack 10. The escape hatch 48 is preferably attached to roof 46 with a cloth hinge and can be held onto the roof with a button and loop combination 50-51, Velcro® or other fastener. To aid this imaginary escape through escape hatch 48, additional fasteners 52 are located immediately adjacent escape hatch 48 on which may be attached the loop ends of ladder 54. The escape is complete as the imaginary hero or heroine captured inside escapes the villain by slipping out the escape hatch 48 in roof 36 and skedaddles down ladder 54 to freedom (See FIG. 10). The ladder 54 can also be attached to the bottom 55 of backpack 10 to facilitate other fanciful play schemes (See FIG. 9). A make believe swing 58 can also be attached to bottom 55 of backpack 10 to swing one's favorite doll.

The sides of backpack 10 can also be festooned with appliqués 18 (See FIGS. 3 and 5). Clear see-through windows 60 in the sides of backpack 10 permit visual observation of imaginary goings on inside. One or more sides or other vertical surfaces of the backpack can include a pocket 62 for storage of a toy or accessory 64. The open ends of pocket 62 can be closed with Velcro® or other fastener when not used for storage.

The inside of the backpack 10 is preferably lined with cloth of varying colors to simulate different rooms or functions. As illustrated in FIG. 7, the space inside backpack 10 is divided into two levels 66 and 68 by divider 70, thereby simulating two floors of a playhouse or other structure. The multilevel effect is enhanced by different colored materials on the interior of the backpack on levels 66 versus 68. Different colored materials on divider 70 and the interior floor 72 of the backpack complete the illusion of a multilevel structure. As also shown in FIG. 7, pockets 74 on the interior of front panel 30 provide interesting locations for dolls, toys, trucks and other accessories usable in the playhouse.

Figure 12:
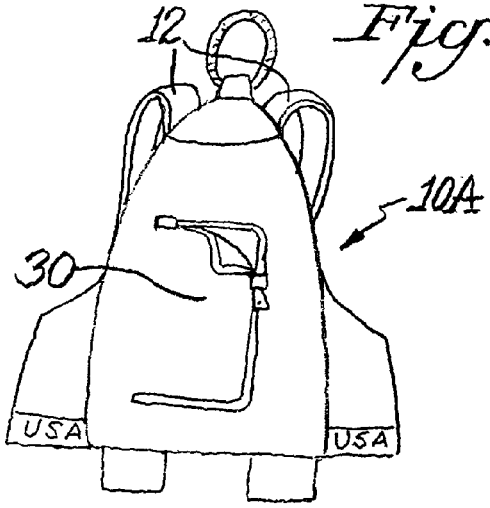
FIG. 12 shows another embodiment of the backpack, namely one shaped like a space vehicle.
Figure 13:
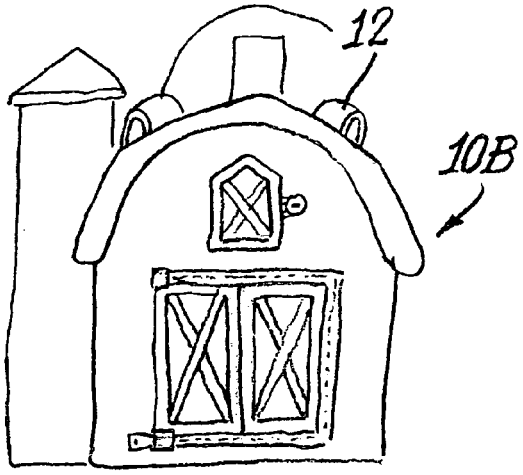
FIG. 13 illustrates another embodiment of the backpack, namely, having the shape of a barn.
Figure 14:
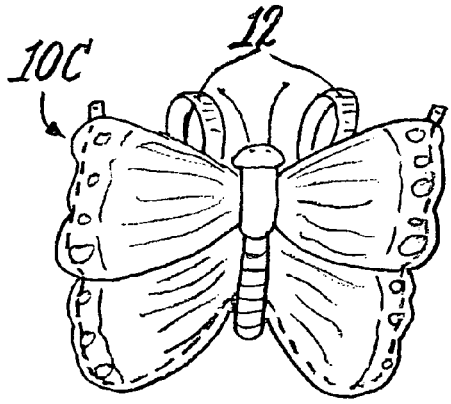
FIG. 14 illustrates an embodiment of the backpack in which a replica of a colorful creature, in this case a butterfly, forms the front of the backpack.

Alternative shapes and forms of backpack 10 are illustrated in FIGS. 12-14. FIG. 12 shows a backpack 10A shaped like a space ship. An operable front panel 30 would expose the interior of the backpack 10 to the user where, instead of dolls and toy furniture, astronaut figures might be strategically placed along with a lunar excursion module (LEM) and like space paraphernalia. FIG. 13 illustrates another embodiment 10B based on a barn. FIG. 14 illustrates an embodiment 10C in which the front of the backpack would be a brightly multicolored butterfly or other visually attractive species of bird, animal or insect. The colors alone create a playtime excursion into the fanciful unknown.

What is claimed is:

1. A portable, interactive playhouse including open interior space for imaginative play activity by child users, comprising:

a) a playhouse body including a first shape retaining, but crushable, wall with an exterior surface and an interior interactive play surface;

b) the playhouse body including at least one additional shape retaining, but crushable, wall spaced from the first wall of the playhouse and having at least one interactive play surface to form an open interior interactive play space in the interactive playhouse, said additional wall having one or more openable panels therein to facilitate access of the child user to the open interior interactive play space;

c) the playhouse body also including top and bottom surfaces which contribute to the formation of the open interior interactive play space in the interactive playhouse;

d) the surfaces of the first and second walls and the top and bottom surfaces of the playhouse body having coordinated colors and surface patterns to stimulate play activity by the child user; and e) at least one strap attached to exterior portions of the first wall of the playhouse body having a length and attachment means sufficient to locate the playhouse on the back of a child user or at locations of interest to the child user.

2. The portable interactive playhouse of claim 1, wherein the open interior interactive play space is divided into multiple levels by a horizontal divider.

3. The portable interactive playhouse of claim 1 wherein one or more straps are adjustably attached to facilitate placement at multiple locations.

4. The portable interactive playhouse of claim 1 wherein a play ladder is attachable to one or more exterior portions of the playhouse.

5. The portable interactive playhouse of claim 1 wherein a play swing is attachable to one or more portions of the playhouse.

6. The portable interactive playhouse of claim 1 wherein a simulated escape hatch is incorporated in one or more surfaces of the playhouse body.

7. The portable interactive playhouse of claim 1 wherein one or more exterior surfaces of the playhouse include decorative features.

8. The portable interactive playhouse of claim 1 wherein the playhouse body includes clear, see-through windows.

9. The portable interactive playhouse of claim 1 wherein at least the exterior shape of the playhouse has the appearance of a dollhouse.

10. The portable interactive playhouse of claim 1 wherein at least the exterior shape of the playhouse has the appearance of a space vehicle.

11. The portable interactive playhouse of claim 1 wherein at least one shape retaining, but crushable, wall comprises a foam core with soft fleece adhered to at least one side of the foam core.

* * * * *